US007287830B2

(12) United States Patent
Ide et al.

(10) Patent No.: US 7,287,830 B2
(45) Date of Patent: Oct. 30, 2007

(54) INK JET PRINTING APPARATUS, INK JET PRINTING METHOD AND PRINTING SYSTEM

(75) Inventors: Daisaku Ide, Tokyo (JP); Hiroshi Tajika, Yokohama (JP); Hitoshi Nishikori, Inagi (JP); Takeshi Yazawa, Yokohama (JP); Atsuhiko Masuyama, Tokyo (JP); Akiko Maru, Kawasaki (JP); Hirokazu Yoshikawa, Kawasaki (JP); Hideaki Takamiya, Tokyo (JP); Akihiko Nakatani, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 237 days.

(21) Appl. No.: 11/041,278

(22) Filed: Jan. 25, 2005

(65) Prior Publication Data

US 2005/0168505 A1 Aug. 4, 2005

(30) Foreign Application Priority Data

Jan. 30, 2004 (JP) ..... 2004-024840

(51) Int. Cl.
*B41J 2/21* (2006.01)

(52) U.S. Cl. ..... 347/43; 347/41; 347/40

(58) Field of Classification Search ..... 347/12–13, 347/15, 19, 41–43, 8, 5, 40
See application file for complete search history.

(56) References Cited

U.S. PATENT DOCUMENTS

| | | | | |
|---|---|---|---|---|
| 5,825,377 | A | 10/1998 | Gotoh et al. | 347/15 |
| 6,244,681 | B1 | 6/2001 | Yano et al. | 347/15 |
| 6,264,305 | B1 | 7/2001 | Inui et al. | 347/40 |
| 6,334,659 | B1 | 1/2002 | Maeda et al. | 347/12 |
| 2003/0035022 | A1 * | 2/2003 | Otsuki | 347/41 |

FOREIGN PATENT DOCUMENTS

JP 2000-177150 6/2000

* cited by examiner

*Primary Examiner*—Stephen Meier
*Assistant Examiner*—Lam S. Nguyen
(74) *Attorney, Agent, or Firm*—Fitzpatrick, Cella, Harper & Scinto

(57) ABSTRACT

An ink jet printing apparatus includes a print head that is an array of a plurality of nozzles arranged according to each color of ink in a predetermined direction. The apparatus is provided with a plurality of print modes, each using a different number of colors of ink for printing. In a print mode using a smaller number of colors of ink for printing (e.g., a monochrome print mode) out of the plurality of print modes, a print method is adopted, in which an image of a predetermined area is formed by a greater print pass count than the print pass count for the predetermined area in a print mode using a greater number of colors of ink for printing (e.g., a color print mode).

6 Claims, 6 Drawing Sheets

INK JET PRINTING APPARATUS, INK JET PRINTING METHOD AND PRINTING SYSTEM

BACKGROUND OF THE INVENTION

1. Field of the Invention

The present invention relates generally to an ink jet printing apparatus and an ink jet printing method using the ink jet printing apparatus and, more particularly, to an ink jet printing apparatus, an ink jet printing method and a printing system employing a different printing method according to the number of colors of ink to be used for printing.

2. Description of the Related Art

With the recent development and spread of digital cameras, there is a need for an image quality comparable to that of silver-salt photos even with an ink jet printing apparatus capable of producing an output of a shot image onto a print medium, such as paper or the like, easily in home-use environment. Conventionally, image quality in print results of color photo tone images is therefore enhanced by carrying out printing using six colors of ink of low-concentration ink of a light cyan and a light magenta added to the ink of four colors of cyan, magenta, yellow, and black.

There is also a trend, in which digital cameras of a single reflex type are marketed at relatively low prices. Ink jet printing apparatuses are therefore used for printing monochrome photo tone images as well as color photo tone images Generally speaking, black ink is mainly used in printing of the monochrome photo tone image. A monochrome image using black ink only is, however, recognized as being slightly tinted with color. For this reason, cyan (or magenta) and yellow are used for correcting color tone, in addition to the black ink that serves as a basic tone of the monochrome image. Further, to lessen a granular impression in low and middle gradations, it is practice to create gray using light cyan and yellow inks. That is, a multi-color printing is also performed by using a plurality of chromatic colors in addition to black as an achromatic color in order to enhance image quality of the monochrome photo tone image. A dot formed by ejected ink may land on a position deviated from an intended position. If this happens, an intended color is not formed. If a color other than an intended achromatic color serving as the basic tone in printing of the monochrome image is evident in a printed image, that particular point appears inordinately noticeable in the image. In performing monochrome printing, therefore, it is desirable that an amount of chromatic color inks to be used are minimized as much as possible.

An attempt has been also made to improve image quality by mounting on the apparatus a plurality of inks of achromatic colors with varying concentrations (gray ink or the like), instead of a plurality of inks of chromatic colors including cyan, magenta, yellow and the like, and rendering gradation of a monochrome image using the plurality of inks of achromatic colors with varying concentrations (see Japanese Patent Application Laid-open No. 2000-177150). In recent years, a number of apparatuses mounted with a plurality of inks with varying concentration of black have been also put on the market.

There may be cases, in which all gradations covering from a highlight portion to a maximum optical density portion (a solid area density portion) are printed using only ink (e.g., black ink in a monochrome photo tone image) that can create an output of the maximum optical density of a is basic tone color. In such cases, particularly in middle gradation, granular impression with the deviation in landing positions of dots is noticeable. For example, contrast in monochrome printing is higher than that in color printing, because in monochrome printing black ink is deposited on a white print medium. A portion of dots locally concentrated due to the deviation of the landing positions tends to become noticeable as rendered as black lines or the like.

The deviation in landing positions of dots may probably be generated by part-to-part variations in nozzle configurations occurring in manufacturing processes of ink jet print heads and noise components such as vibration of the apparatus during printing.

As described in the foregoing, the deviation in landing positions of dots tends to be more noticeable in middle gradations with a decreasing number of colors of ink used, as symbolized by the case using ink of a single color only. To state it another way, the more the number of colors of ink used, the more the total amount of ink applied to a predetermined area on the print medium. This results in ink coverage on the surface of the print medium becoming higher. On the other hand, if the number of colors of ink used becomes less, the total amount of ink applied to the predetermined area on the print medium becomes small, resulting in the link coverage becoming lower. The deviation in landing positions of dots in higher ink coverage does not substantially affect the image quality. If the deviation in landing positions of dots occurs in low ink coverage, however, the image quality is appreciably affected. This is because of the following reason. Specifically, in the condition having the low ink coverage, there is a greater likelihood that the color of the print medium itself will be visible as compared the condition having the high ink coverage. The deviation in dot landing positions then helps make the color of the printing medium itself look to cyclically vary. Moreover, in monochrome images, the deviation in dot landing positions becomes even more noticeable because of a higher contrast between the color of ink and the color of the print medium, in addition to the originally low ink coverage from printing using the black ink only.

Deviation in dot landing positions involved uniquely with a nozzle row is probably attributable to the deviation in dot landing positions actually occurring in a printing apparatus. This problem of the deviation in dot landing positions involved uniquely with the nozzle row is due to part-to-part variations in the manufacturing processes of the print head. The problem is due to ejection characteristics of each individual print head, such as the dot landing position, the amount of ink ejected, and the like. Other possible reasons for the deviation in dot landing positions include: effect from a satellite or ink droplets collaterally ejected in addition to the main ink droplets during ejection of ink droplets; and fluctuations in speed of the carriage during scanning.

The present invention thus identifies a problem of degraded image quality noticeable in a print mode using a relatively small number of colors of ink, such as the monochrome print mode, the problem being attributable to the deviation in dot landing positions occurring from characteristics unique to the nozzle row. In view of the foregoing problem based on a relation between the number of colors of ink used and degraded image quality, it is an object of the present invention to provide an ink jet printing apparatus and an ink jet printing method capable of producing an output of a print result of high image quality showing deviation in dot landing positions not noticeable even with a small number of colors of ink used for printing.

SUMMARY OF THE INVENTION

An ink jet printing apparatus according to the present invention forms an image on a print medium by performing the following two specific operations. Specifically, the apparatus includes a print head that has an array of a plurality of nozzles for ejecting ink of a plurality of colors. The apparatus lets the print head make a plurality of scan operations in a predetermined direction on a print medium. In each of these scan operations, the ink is ejected from the plurality of nozzles onto the print medium. This forms a main scan operation. The other operation is a sub-scan operation performed between each of the plurality of scan operations. In the other operation, the print medium and the print head are moved relative to each other a predetermined amount in a direction different from a direction of the main scan operation of the print head. The apparatus includes mode selection means and control means. The mode selection means select one print mode from among a plurality of print modes including a first print mode and a second print mode. The first print mode involves a relatively large number of colors of ink used for printing. The second print mode involves a number of colors of ink smaller than that in the first print mode. The control means control the print operation performed according to the mode selected by the mode selection means. The apparatus is characterized in the following points. Specifically, the control means cause an image to be printed by letting the print head make a plurality of main scan operations for a predetermined area on the print medium. The control means further ensure that the number of main scan operations performed for the predetermined area on the print medium in the second print mode is greater than that in the first print mode.

The control means may be arranged to achieve the following. Specifically, in the first print mode and the second print mode, printing of an image on the predetermined area on the print medium is completed through a plurality of scan operations by the print head, each scan operation comprising the print operation achieved through the scan operation by the print head and a paper feed operation covering a width smaller than a print width in a paper feed direction through a single scan operation by the print head, the print operation and the paper feed operation being repeatedly performed.

A printing system according to the present invention uses an ink jet printing apparatus that forms an image on a print medium by performing the following two specific operations. Specifically, the apparatus includes a print head that has an array of a plurality of nozzles for ejecting ink of a plurality of colors. The apparatus lets the print head make a plurality of scan operations in a predetermined direction on a print medium. In each of these scan operations, the ink is ejected from the plurality of nozzles onto the print medium. This forms a main scan operation. The other operation is a sub-scan operation performed between each of the plurality of scan operations. In the other operation, the print medium and the print head are moved relative to each other a predetermined amount in a direction different from a direction of the main scan operation of the print head. The printing system includes a plurality of print modes, print mode selection means, print method determination means, and control means. Each of the plurality of print modes uses a different number of colors of ink for forming the image on the print medium. The print mode selection means select a specific print mode to be used from among the plurality of print modes. The print method determination means determine a print method corresponding to the print mode selected by the print mode selection means. The control means control operations such that printing of an image on a predetermined area on the print medium is completed through a plurality of main scan operations. The printing system is characterized in the following point. Specifically, the print method determination means set up a print method in a predetermined print mode using a smaller number of colors of ink for printing than in other print modes, so as to have a greater number of main scan operations for printing the image on the predetermined area as controlled by the control means than in the other print modes.

An ink jet printing method according to the present invention is applied to an ink jet printing apparatus that forms an image on a print medium by performing the following two specific operations. Specifically, the apparatus includes a print head that has an array of a plurality of nozzles for ejecting ink of a plurality of colors. The apparatus lets the print head make a plurality of scan operations in a predetermined direction on a print medium. In each of these scan operations, the ink is ejected from the plurality of nozzles onto the print medium. This forms a main scan operation. The other operation is a sub-scan operation performed between each of the plurality of scan operations. In the other operation, the print medium and the print head are moved relative to each other a predetermined amount in a direction different from a direction of the main scan operation of the print head. The ink jet printing method includes a selection process and a print process. The selection process selects a mode from among a plurality of modes, each using a different number of colors of ink for printing the image. The print process prints the image on the print medium according to the mode selected in the selection process. The ink jet printing method is characterized by the following point. Specifically, the print process performs printing by setting up a print method in a predetermined print mode using a smaller number of colors of ink for printing than in other print modes, so as to have a greater number of main scan operations for printing the image on the predetermined area as controlled by the control means than in the other print modes.

The present invention has the following effect. Specifically, in the first print mode yielding a relatively low ink coverage in the predetermined area on the print medium because of the small number of colors of ink used for printing, the number of main scan operations is increased in the predetermined area as compared with the second print mode yielding a relatively high ink coverage because of the large number of colors of ink used for printing. This arrangement allows a print result of high image quality to be produced showing deviation in dot landing positions not noticeable even with the small number of colors of ink used for printing.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Preferred embodiments of the present invention will be described in detail with reference to the accompanying drawings.

Figure 1:
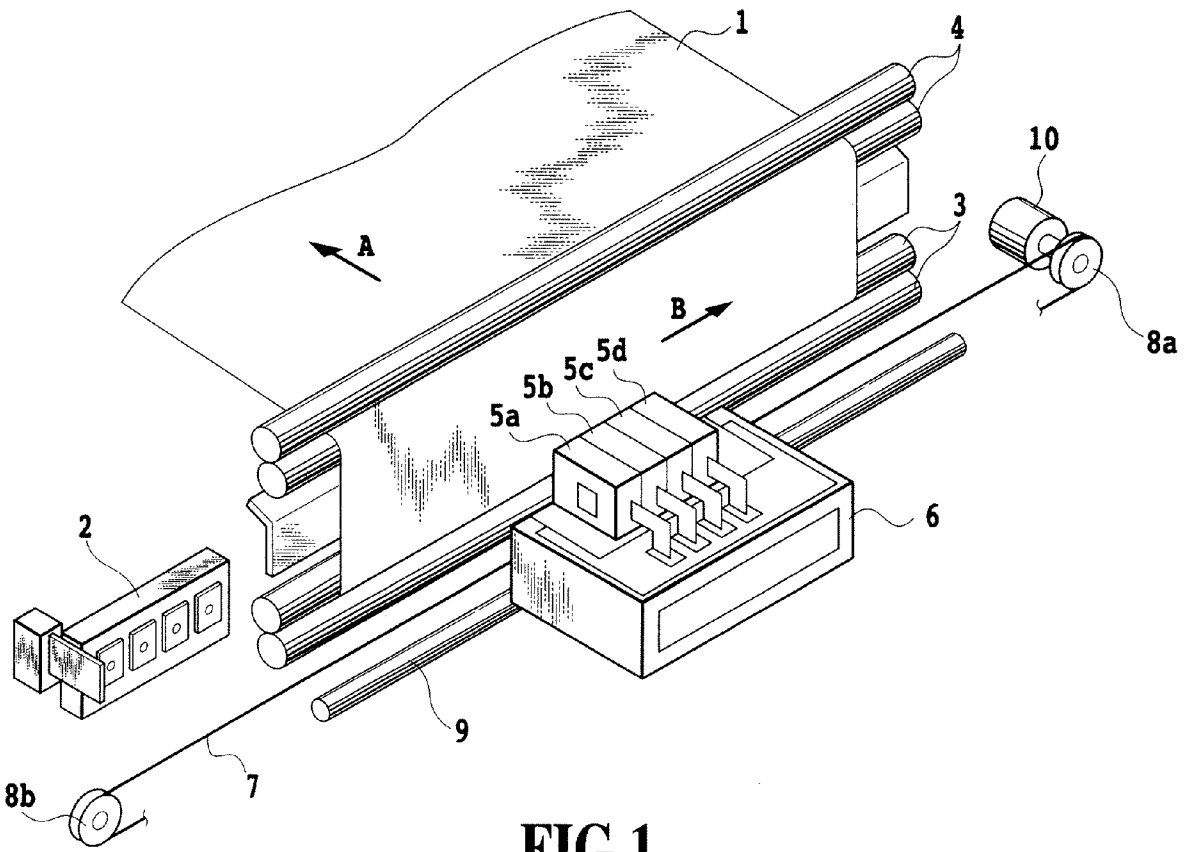
FIG. 1 is a perspective view showing an ink jet printing apparatus according a preferred embodiment of the present invention.

FIG. 1 is a view showing a typical ink jet printing apparatus applicable to the present invention. A reference numeral 1 represents paper, a plastic sheet, or other print medium of a sheet form (hereinafter also referred to as a "print sheet"). A stack of a plurality of print sheets 1 loaded in a cassette or the like is fed, one at a time, by a pick-up roller (not shown). A reference numeral 3 represents a pair of first feed rollers and a reference numeral 4 represents a pair of second feed rollers. The pair of first feed rollers 3 and the pair of second feed rollers 4 are disposed at a predetermined distance away from each other. Each of pairs is driven by an individual stepping motor (not shown) to transport the print sheet 1 in a direction of arrow A.

Reference numerals 5*a* to 5*d* represent ink tanks connected to a print head that includes an array of a plurality of nozzles for ejecting ink. A reference numeral 6 represents a carriage mounted with the ink tanks 5*a* to 5*d* and the print head. The print head is mounted on the carriage 6 such that nozzle surfaces oppose the print sheet 1.

The carriage 6 is coupled to a carriage motor 10 via a belt 7 and pulleys 8*a*, 8*b*. It is therefore so configured that the carriage 6 is driven by the carriage motor 10 to make a reciprocating scan motion along a guide shaft 9.

Through the configuration as described in the foregoing, the carriage 6 moves from a home position in a direction of arrow B by way of a proximal end (a left side end in FIG. 1) of the print sheet 1 (this motion is referred to as a "main scan"). At this time, the print head ejects ink to the print sheet 1 according to an ejection signal. After the carriage 6 moves to a distal end (a right side end in FIG. 1) of the print sheet 1, the carriage then returns to the home position as necessary. At the home position, the carriage 6 removes clogging from the nozzle by using an ink recovery device 2. The feed roller pairs 3, 4 are then driven to transport the print sheet 1 in the direction of arrow A over a distance equivalent to one line (this motion is referred to as a "sub-scan"). The main scan as the motion for printing and the sub scan as the paper feed motion are alternately repeated and thereby required printing is performed on an entire surface of the print sheet 1.

According to the preferred embodiment of the present invention, the ink tanks 5*a* to 5*d* include tanks of the following four colors. The tanks of four colors of ink are specifically: a black (Bk) ink tank 5*a*, a cyan (C) ink tank 5*b*, a magenta (M) ink tank 5*c*, and a yellow (Y) ink tank 5*d*. The cyan (C) ink tank 5*b* is of dual structure including a light cyan (Lc) ink tank containing the light cyan (Lc) ink having a lower concentration than the cyan ink. Similarly, the magenta (M) ink tank 5*c* is of dual structure including a light magenta (Lm) ink tank containing the light magenta (Lm) ink having a lower concentration than the magenta ink. The configuration of ink of colors mounted in the printing apparatus is not limited to the aforementioned configuration and any other configuration is possible. According to the preferred embodiment of the present invention, each of the cyan ink tank and the magenta ink tank is structured as a single cabinet containing two sub-tanks, one for light ink and the other for dark ink. The present invention is not limited to this configuration. The ink tank may be provided separately for each color of ink.

The ink tanks are arranged in the order of 5*a*, 5*b*, 5*c*, and 5*d* from the home position side. It should be noted that the present invention is not limited to the aforementioned arrangement and any other order will perfectly serve the purpose.

The structure of the print head according to the preferred embodiment of the present invention will be described in the following.

Figure 2:
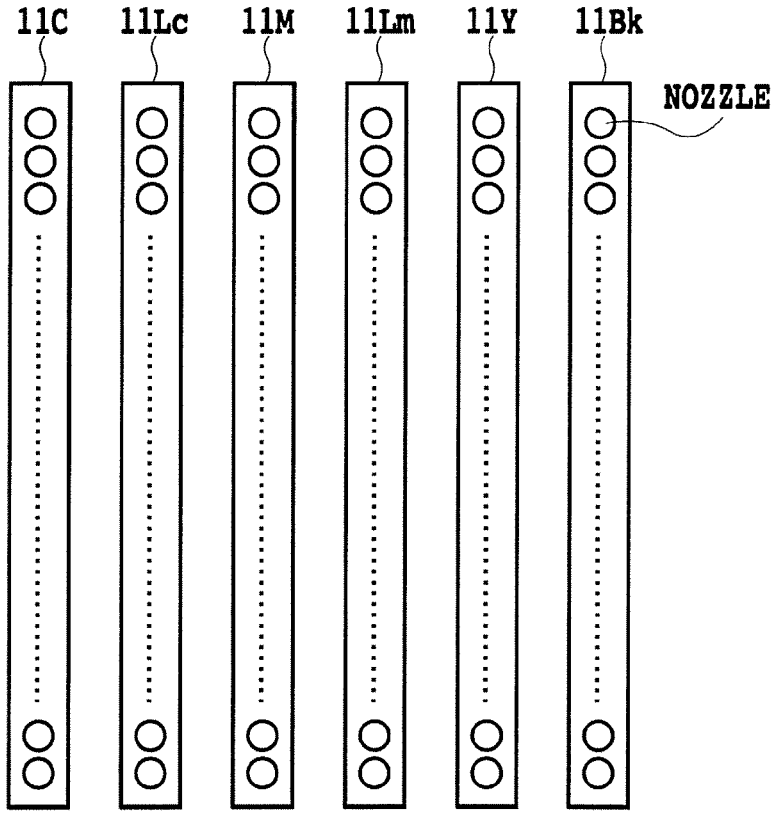
FIG. 2 is a schematic view showing nozzle rows of a print head.

FIG. 2 is a schematic view showing the print head according to the preferred embodiment of the present invention. FIG. 2 shows the surface opposing the print medium, that is, a nozzle surface. The print head is mounted in the printing apparatus such that the nozzle surface opposes a print surface of the print sheet to be transported. The print head according to the preferred embodiment of the present invention is arranged as follows. Specifically, a plurality of nozzles disposed in the nozzle surface for each color of ink to be ejected is arranged in a row. The direction in which the plurality of nozzles is arranged is vertical relative to the scanning direction of the print head. Further, nozzle rows are arranged in the scanning direction of the print head. These allow printing to be efficiently performed over a wide range with a single print scan motion. Referring to FIG. 2, the print head is provided with an array of nozzle rows for different colors of ink The nozzle rows are specifically a cyan ejection nozzle row 11C, a light cyan ejection nozzle row 11Lc, a magenta ejection nozzle row 11M, a light magenta ejection nozzle row 11Lm, a yellow ejection nozzle row 11Y, and a black ejection nozzle row 11Bk. These nozzle rows are arranged as shown in FIG. 2. The cyan ejection nozzle row 11C and the light cyan ejection nozzle row 11Lc are connected to the cyan (C) ink tank 5*b*. The magenta ejection nozzle row 11M and the light magenta ejection nozzle row 11Lm are connected to the magenta (M) ink tank 5*c*. The yellow ejection nozzle row 11Y is connected to the yellow (Y) ink tank 5*d*. The black ejection nozzle row 11Bk is connected to the black (Bk) ink tank 5*a*.

Each nozzle row includes 512 nozzles arranged at a pitch of 1200 dpi. Each nozzle is provided with a heater. Upon ejection of ink, the heater is heated to generate air bubbles in part of the ink near an ejection port. A predetermined amount of ink is ejected as an ink droplet in a predetermined direction through a pressure generated by the air bubbles. As such, the printing apparatus according to the preferred embodiment of the present invention employs an ink ejection method according to a bubble jet system. It should, however, be understood that the present invention is not limited thereto. It will be obvious that another ink ejection method, such as a piezo system or the like, may be employed.

Each of the nozzles arranged in the print head ejects ink when the corresponding heater is individually driven on the basis of image data. Each nozzle is capable of producing a small dot of about 2 nanogram (ng) ink ejected therefrom.

A structure of a printing system including a host computer and an ink jet printing apparatus will be described in the following.

Figure 3:
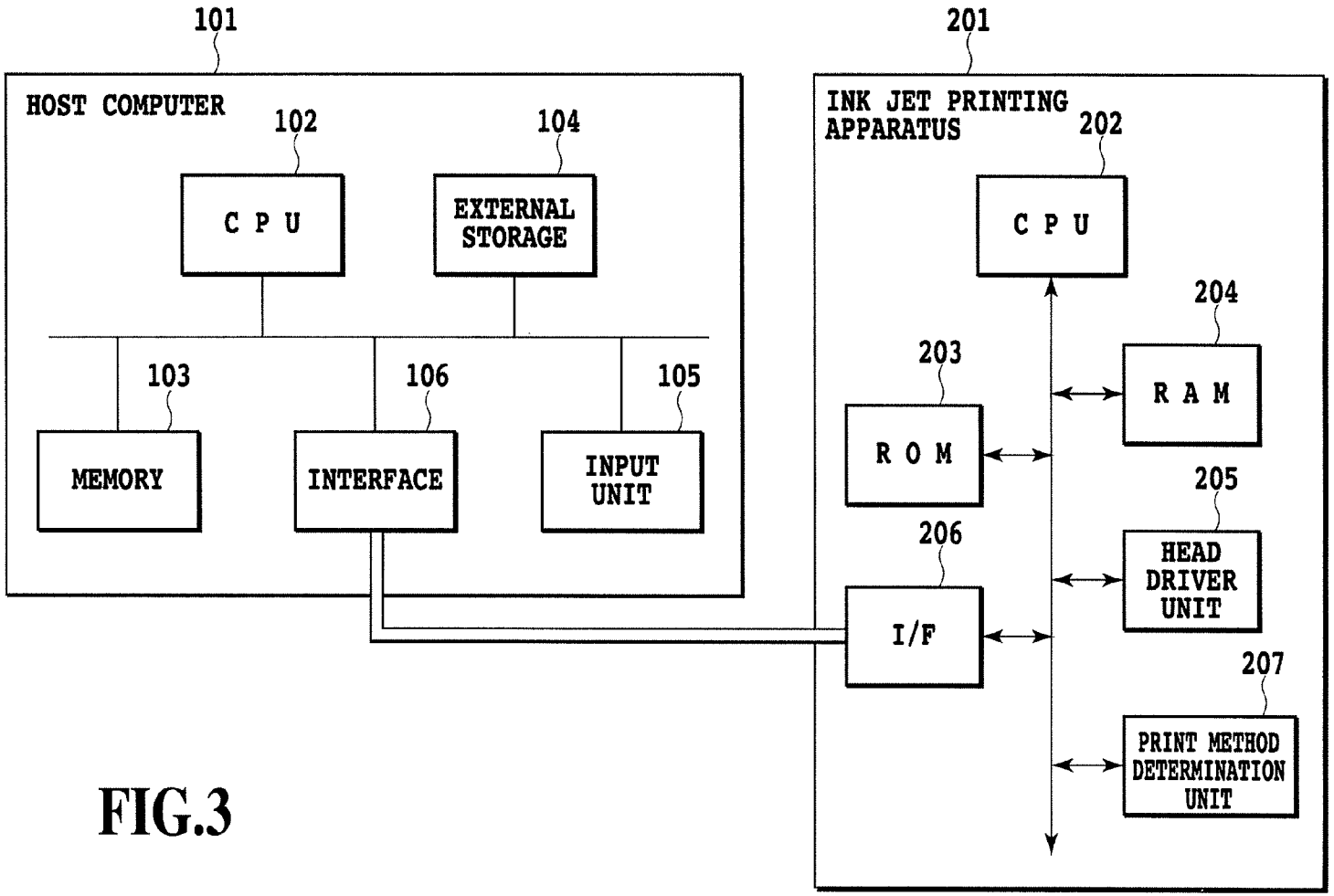
FIG. 3 is a block diagram showing an ink jet printing system according to a preferred embodiment of the present invention.

FIG. 3 is a block diagram showing a printing system according to a preferred embodiment of the present invention.

The system comprises a host computer 101 and an ink jet printing apparatus 201. The host computer 101 includes a CPU 102, a memory 103, an external storage 104, an input unit 105, and an interface to the ink jet printing apparatus 201. The ink jet printing apparatus 201, on the other hand, includes a CPU 202, a ROM 203, a RAM 204, a driver unit (not shown), an I/F 206, a print method determination unit 207, and the like. More specifically, the CPU 202 performs an overall control of the ink jet printing apparatus 201. The ROM 203 stores a control program The RAM 204 serves as a work memory. The driver unit controls driving of driving members represented by a head driver unit 205 that controls driving of the print head. The I/F 206 serves as an interface to the host computer 101. The print method determination unit 207 determines the specific print method according to the print mode.

The CPU 102 of the host computer 101 realizes color processing and quantization processing to be described later by executing the program stored in the memory 103. It is here assumed that a portion within the CPU 102 performing color transformation processes is called a color processing unit and that a portion within the CPU 102 performing quantization processes for data that has been color-processed is called a quantization unit. Programs corresponding to these different processing units are stored in the external storage 104 or provided by an external device. The host computer 101 is connected to the ink jet printing apparatus 201 via the interface 106. The host computer 101 transmits the print data that have performed color processing and the like to the ink jet printing apparatus 201. When the ink jet printing apparatus 201 receives the print data, the print method determination unit 207 determines the applicable print method according to the print data and then prepares ejection data corresponding to each nozzle and then the head driver unit 205 drives corresponding nozzles to carry out printing according to the ejection data.

The printing system according to the preferred embodiment of the present invention is provided with a plurality of print modes, each representing a specific feature required for a print result. The plurality of print modes include at least a color print mode, in which an image of an ordinary color photo tone is printed, and a monochrome print mode, in which an image of an ordinary monochrome photo tone is printed. Printing is performed using the specific print method as appropriately determined according to the mode selected by the user.

A flow of image processing performed by the host computer will next be described in detail.

Figure 4:
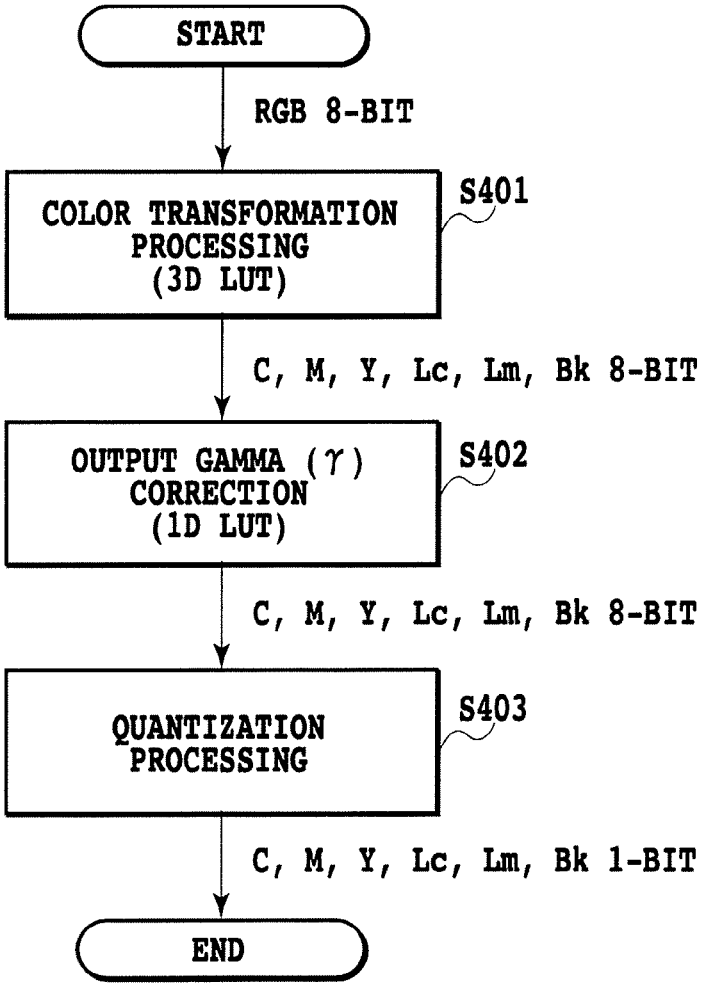
FIG. 4 is a flowchart showing a flow of color transformation process and quantization process.

FIG. 4 is a flowchart for illustrating image processing. The flowchart shows that 8-bit (256 gradations) image data of each of R (red), G (green), and B (blue) inputted is outputted as 1-bit data of each of C, M, Y, Lc, Lm, and Bk.

The 8-bit data of each color of R, G and B is first transformed to the 8-bit data of each color of C, M, Y, Lc, Lm, Bk corresponding to an output color of the printing apparatus by a three dimensional lookup table (3D LUT) (step 401). This process is to transform an RGB-based color inputted to a CMY-based color outputted. Specifically, the input data representing the three primary colors (RGB) for the additive mixture of colors, such as a display or other light emitting body, must be transformed to data suitable for CMY-based colors used in the ink jet printing apparatus.

The 3D LUT used for color processing retains data discretely. Data other than data retained in the 3D LUT is obtained through interpolation. The interpolation is a known technique and a detailed description of the same will be omitted herein.

The 8-bit data of each color of C, M, Y. Lc, Lm, Bk, which the color processing has been performed, is then subjected to an output gamma (γ) correction performed by a single dimensional LUT (1D LUT) (step 402). The relationship between the number of print dots per unit area and an output characteristic (reflection density or the like) is not in many cases linear. A linear relation is therefore guaranteed by the output gamma (γ) correction between the input level of 8-bit color data and the output characteristic at that particular time.

The operation of the color processing unit has so far been explained. Specifically, the 8-bit data of each of input colors, R, G, B has been transformed to the 8-bit data of each of output colors, C, M, Y, Lc, Lm, Bk that the printing apparatus has.

The ink jet printing apparatus according to the preferred embodiment of the present invention is a binary printing apparatus. The 8-bit data of each of colors are therefore quantized to binary data of each of colors by the quantization unit (step 403). The conventionally known error diffusion technique or dithering technique is used for quantization.

A plurality of 3D LUT's used for color processing is provided according to ink color configurations and print result requirements. The specific 3D LUT is selected according to the print mode or the like. Specifically, according to the preferred embodiment of the present invention, at least two types of 3D LUT's are provided, one for the color print mode and the other for the monochrome print mode. Each type of LUT's has a specific processing parameter. For example, a 3D LUT for six-color print mode transforms RGB 8-bit data to C, M, Y, Lc, Lm, Bk 8-bit data. The color print mode is not limited to the aforementioned six colors. The color print mode may be a configuration of seven colors plus R. Or, the color print mode may even be a configuration of four colors only of C, M, Y, and Bk. It goes without saying that the color print mode may further be subdivided into the 6-color mode, 4-color mode, and the like. A 3D LUT for the monochrome print mode transforms RGB 8-bit data to Bk, C, Y 8-bit data. According to the preferred embodiment of the present invention, cyan and yellow are added for color tone correction to the colors of ink in the monochrome print mode. It should be noted that black only should perfectly serve the purpose.

The 1D LUT following the 3D LUT may be provided in multiple numbers for different modes as with the 3D LUT's or one provided commonly for all modes.

A flow from mode selection by the user to generation of print data will be described.

Figure 5:
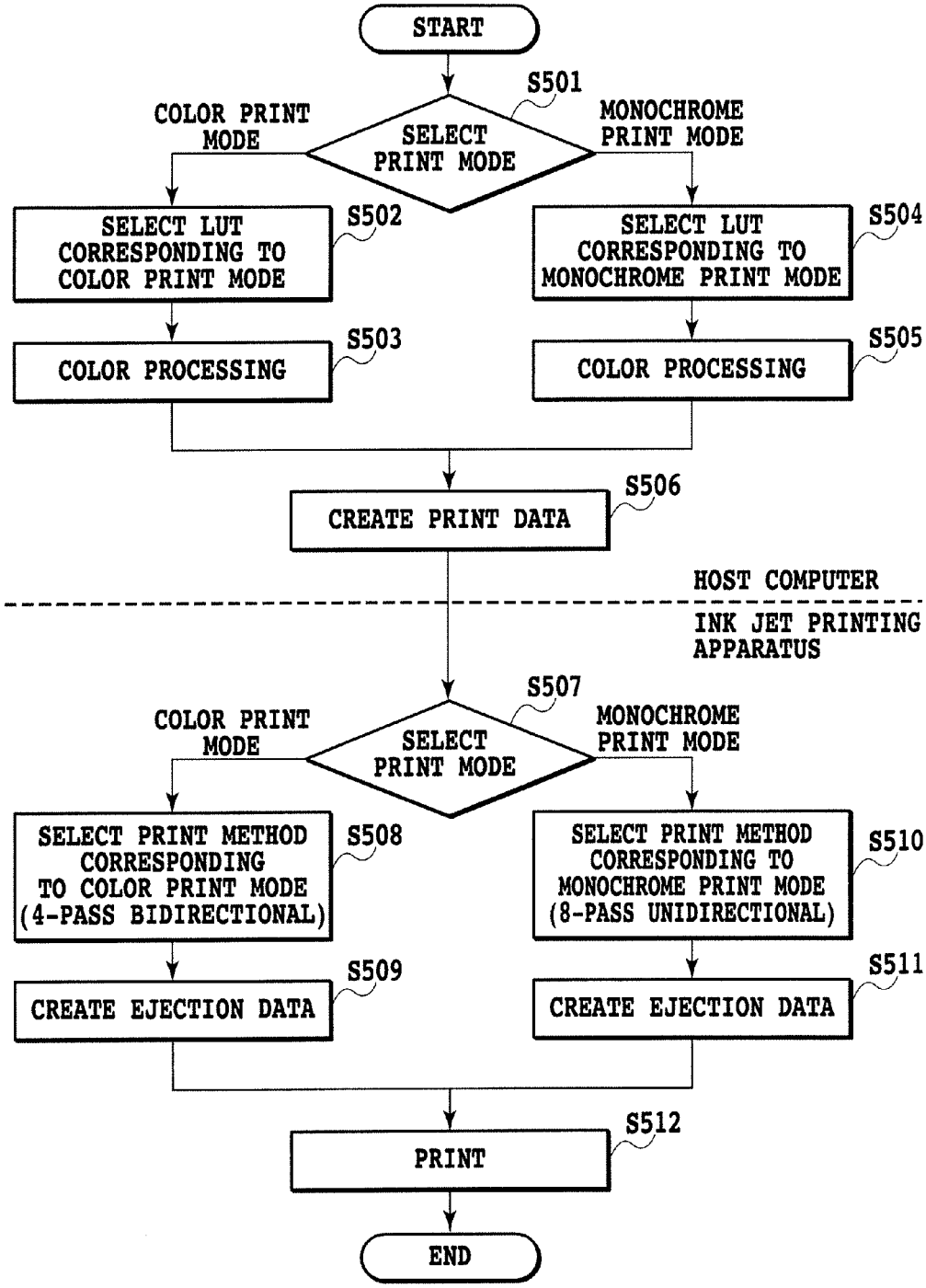
FIG. 5 is a flowchart showing an entire flow up to printing for different print modes.

FIG. 5 is a flowchart showing a flow from mode selection to generation of print data according to the preferred embodiment of the present invention.

The user selects a print mode using an operation screen, an operation button, or the like of the host computer (step 501). If, for example, the color print mode is selected (step 502), the color transformation processing using the 3D LUT for the color print mode is performed (equivalent to the processing performed in step 401 of FIG. 4) (step 503). If the monochrome print mode is selected (step 504), on the other hand, the color transformation processing using the 3D LUT for the monochrome print mode is performed (step 505). When the color transformation processing in step 503 or step 505 is completed, the aforementioned output gamma (γ) correction, quantization correction, or the like is performed so that the print data is created (step 506). The created print data is transferred to the printing apparatus and printing is performed by the printing apparatus.

The present invention varies the print method employed according to the print mode. In order to vary the print method according to the print mode, the ink jet printing apparatus that receives the print data therefore processes the print data to prepare ejection data corresponding to each nozzle.

Print methods according to different print modes will be described in the following. Specific print methods will be described based on the following specific embodiments. Processing performed by the ink jet printing apparatus in FIG. 5 (processing of step 507 and onward) will be described in Embodiment 1.

EMBODIMENT 1

As the number of colors of ink used for printing decreases, the total amount of ink applied to the print medium decreases to lower ink coverage on the surface of the print medium. If the same print method is employed for printing in the color print mode using a greater number of colors of ink and in the monochrome print mode using a smaller number of colors of ink, the deviation in dot landing positions is more noticeable in the print result in the monochrome print mode than in the color print mode.

In the monochrome print mode according to the preferred embodiment of the present invention, therefore, the image is formed by making the print head scan the predetermined area a greater number of times (hereinafter referred to as a "pass count") than in the color print mode. The deviation in dot landing positions is thereby made to be less noticeable. To state it another way, according to the preferred embodiment of the present invention, in the monochrome print mode, in which the number of colors of ink used for printing is smaller than in the color print mode, the image is printed by using a method that the pass count representing the number of scan motions covering the predetermined area for completing the image is greater. The preferred embodiment of the present invention is aimed at reducing degraded image quality in the monochrome print mode, in which it is easy to notice the deviation in dot landing positions.

Figure 6A:
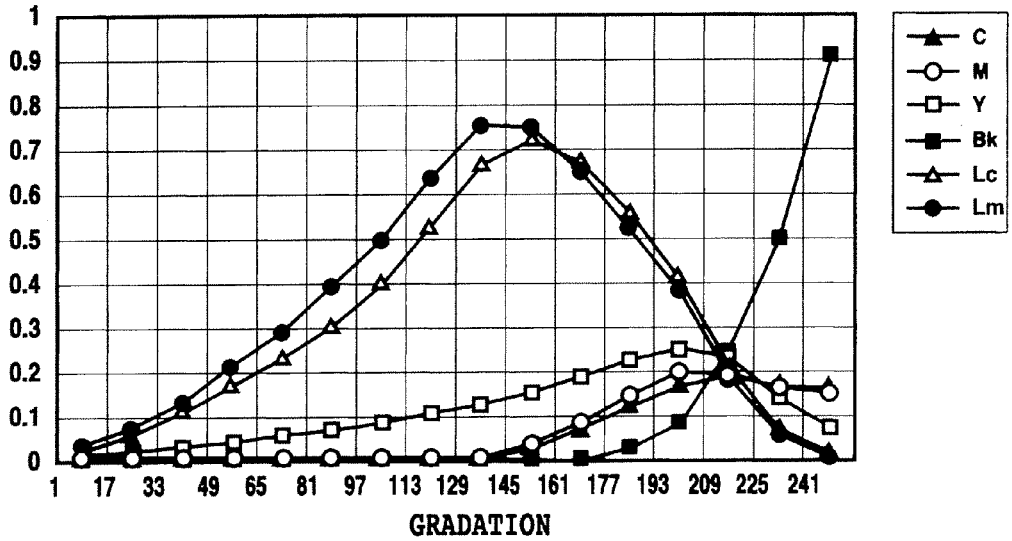
FIG. 6A is a graph showing a relation between a gradation value and an ink usage rate in a color print mode.
Figure 6B:
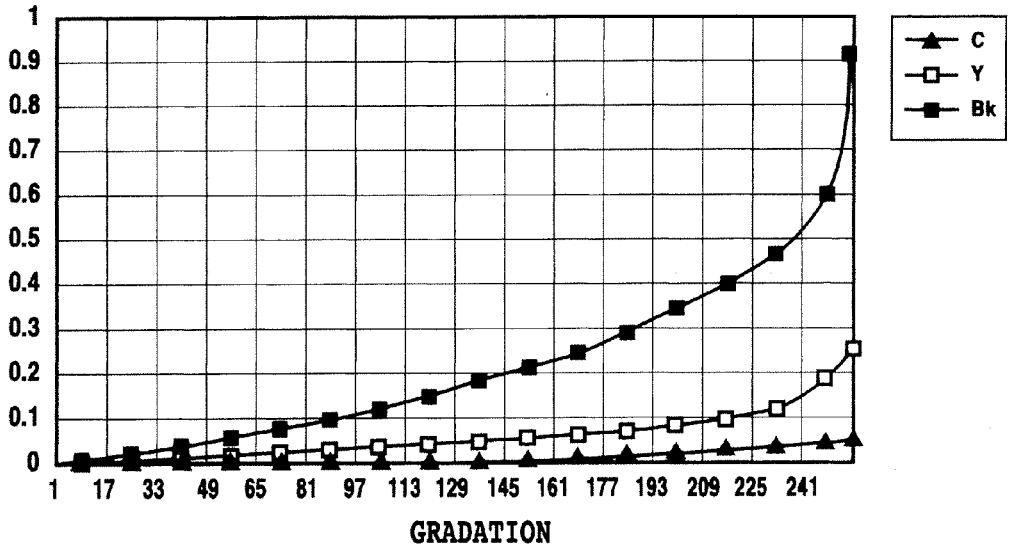
FIG. 6B is a graph showing a relation between a gradation value and an ink usage rate in a monochrome print mode.

FIGS. 6A and 6B are graphs showing relations between black gradation values and ink usage rates in different modes. FIG. 6A is the graph for the color print mode, while FIG. 6B is the graph for the monochrome print mode.

Specifically, FIG. 6A shows output values or ink usage rates of different colors of ink corresponding to black gradation values in the color print mode. Here, light cyan (Lc) and light magenta (Lm) having lower color concentrations are used, in addition to cyan (C), magenta (M), yellow (Y), and black (Bk). According to FIG. 6A, Lc, Lm, and Y are used to represent different gradations in a low density zone. In a transition phase with a gradual increase in density from a low density to a high density, dots tend to be printed discretely and ink with an even lower concentration is used to reduce a granular impression. This approach is taken, since ink dots formed by ink of a light color are less noticeable on the print medium.

FIG. 6B shows output values of different colors of ink corresponding to black gradation values in the monochrome print mode. According to FIG. 6B, the black ink stably maintains high output values than ink of other colors and exhibits a monotonic increase trend both in a highlight zone with lower density values and a high density zone with high density values. In FIG. 6B, cyan and yellow are the only two colors of ink applied other than black. The output signal values of these colors keep a low level. In Embodiment 1, these two chromatic colors are added for correcting of "coloring" of a black image. In the example of FIG. 6B, the ink of one chromatic color (the yellow ink) of the ink of the two chromatic colors (cyan and yellow ink) is used throughout the entire density zones from the low density zone to the high density zone as with the black ink. The amount used of ink of the other chromatic color (the cyan ink) is kept smaller as compared with that of the ink of the other chromatic color (yellow).

In FIG. 6B, yellow and cyan are used as the chromatic colors. Depending on the composition of the black ink to be used, however, the chromatic colors used for correcting the coloring may be yellow and magenta.

A comparison of the middle gradation levels of FIGS. 6A and 6B will reveal that the amount of ink applied to the print medium is apparently smaller in the monochrome print mode than in the color print mode. In addition, in the monochrome print mode, the black ink is positively used even in the low to medium gradation levels, resulting in a ratio of the black ink of the total amount of ink applied being extremely high.

More specifically, the black ink is used so that luminance $\gamma$ is about 1.8 from the highlight portion to the maximum density portion. If the amount of black ink used per unit area increases, even though the black ink is used as an achromatic ink, the ink exhibits slight chroma depending on the type of the print medium used. This at times results in tone not right for a monochrome photo being produced. According to Embodiment 1, therefore, cyan and yellow are used as coloring correcting components to achieve the original achromatic color of black. In printing of a monochrome image, an extremely small amount of cyan and yellow is thereby added. In order to correct the coloring, cyan and yellow are used in Embodiment 1; however, cyan and yellow are not the only ink of colors and magenta or any other color may be used. The important point to remember herein is that ink of these chromatic colors is used only as coloring correcting components and that the ink of these chromatic colors is not used for generating gray or process black for making gradation changes smoother. The extremely small addition of the ink of these chromatic colors is to prevent image quality from degrading that deviation in landing positions of dots of chromatic colors causes the original colors of the ink of these chromatic colors to be evident on the print medium and thereby dots of ink of chromatic colors are noticeable in a monochrome photo image This phenomenon occurs due to the following reason.

It is further designed to increase the amount of ink used from the highlight portion to the maximum density portion at a monotonic pace in order to make it easier to create color tones and gradations of monochrome photos. This helps make color tones uniform throughout the highlight portion, the middle density portion, and the maximum density portion even with unit-to-unit variations in mass-production of the ink jet printing apparatuses.

Changes in the pass count in the print method in each of different print modes having such an ink usage rate will be described.

There is a print method called a one-pass print, in which all nozzles of the print head are used to print data during one main scan motion and the paper is fed over a distance equivalent to the width of the nozzle row. This one-pass print method covers a wide print width in one pass, requiring a shorter period of time for printing; however, deviation in dot landing positions is readily and directly incorporated in the print image. For example, uneven lines occur due to deviation in landing positions. To prevent the image quality from degrading as caused by such a landing error, therefore, the multi-pass print method, in which the pass count over the aforementioned predetermined area is increased to complete the image, is employed.

Referring back to FIG. 5, according to Embodiment 1, the print method determination unit 207 of the ink jet printing apparatus determines the print method based on the print data transmitted from the host computer. The selection of the print mode by the printing apparatus, whether the mode be the color print mode or the monochrome print mode, may be determined based on the print data transferred from the host computer. Alternatively, the host computer may transmit a command indicating the print mode, together with the print mode, and the printing apparatus may analyze the command and, based on the analysis made, select the print mode. The print mode, in which printing is performed, is thus determined and processing is then performed according to the print mode.

In the color print mode according to Embodiment 1, a 4-pass print method is selected (step 508). The 4-pass print method uses print data divided into ¼ at random so as to complete the image of the predetermined area through four main scan operations and a paper feed of ¼ of the width of the nozzle row. This print method is called the multi-pass print. In the multi-pass print method, a printing operation by scanning of the print head and a print medium feeding operation covering a width narrower than a print width in the paper feed direction printed through one scan motion by the print head are repeated and thereby the printing of the image over a predetermined area on the print medium is completed through a plurality of scan motions by the print head.

In the monochrome print mode, on the other hand, an 8-pass print method corresponding to the pass count doubling that of the color print mode is selected (step 510). Ejection data corresponding to the respective print methods are then created (steps 509 and 511). Printing is then performed based the ejection data (step 512). According to Embodiment 1, the ink jet printing apparatus creates the ejection data. The present invention is not, however, limited to that creation, and the ejection data may be created by the host computer.

The greatest effect can be derived in the middle gradation portions, if a large print pass count is provided in the monochrome print mode.

For example, as shown in FIG. 6A, the image is printed in the middle gradation portions with mostly the light cyan ink and the light magenta ink in the color print mode. The image is therefore printed with the deviation in ink droplet landing positions for two rows of the ejection nozzle row 11Lc and the ejection nozzle row 11Lm as shown in FIG. 2 thinned down to ¼ for each main scan. This is translated into eight-fold dispersion in terms of only the deviation in dot landing positions when compared with the deviation in dot landing positions in printing of 1 pass 1 ejection nozzle row.

In the monochrome print mode, on the other hand, the image is printed with substantially only the black ink as shown in FIG. 6B. Assuming then that printing is performed in 4 passes, the same as in the color print mode, the image is printed with the deviation in ink droplet landing positions for one row of the ejection nozzle row 11Bk as shown in FIG. 2 thinned down to ¼ for each main scan. This is translated into only four-fold dispersion of the deviation in dot landing positions when compared with the deviation in dot landing positions in printing of 1 pass 1 ejection nozzle row. The factor of contrast of the black is added to this. The print result of the 4-pass printing in the monochrome print mode thus reveals degraded image quality as compared with the print result of the 4-pass printing in the color print mode.

However, as printing is performed in 8 passes in the monochrome print mode according to the preferred embodiment of the present invention, the deviation in dot landing positions is dispersed eight-fold as compared with the deviation in dot landing positions in printing of 1-pass 1 ejection nozzle row. The print result ensures a high image quality comparable to that of the color print mode.

It goes without saying that a multi-pass printing having a pass count greater than eight yields better image quality. In addition, if an apparatus requires 6 passes even in the color print mode, it is then preferable that 12 passes or more are required in the monochrome print mode.

In the monochrome print mode, color toning by using chromatic colors may not be required and the black ink only is required, depending on the print medium. In this case, the amount of the black ink used is increased at a monotonic pace from the highlight portion to the maximum density portion, as with the use of the black ink in FIG. 6B. This is done to facilitate rendering of gradation.

In this case, too, the degraded image quality due to deviation in dot landing positions will not occur in printing of middle gradations if 8-pass printing is performed in the monochrome print mode, as opposed to 4-pass printing in the color print mode.

Commercially, there may be a need for single color printing, in addition to the monochrome print mode. In this case, too, it is only necessary to set a pass count more than in the color print mode and use only the ink of the hue corresponding to the print hue required.

EMBODIMENT 2

The print methods in the monochrome print mode and the color print mode were described in Embodiment 1. It should herein be noted that the present invention is characterized in the print mode using a small number of colors of ink for printing. In such a print mode, means for performing printing with a greater pass count as compared with the print mode using a greater number of colors of ink are also effective in a relation between the color print mode using only the four colors of C, M, Y, and Bk (hereinafter referred to as a "4-color print mode") and the color print mode using the aforementioned six colors or seven colors (hereinafter referred to as a "6-color print mode").

Specifically, the total amount of ink applied to the print medium tends to be smaller in the 4-color print mode than in the 6-color print mode. As a result, the ink coverage is also lower in the 4-color print mode. In the 4-color print mode, therefore, a print result with a high image quality showing deviation in dot landing positions less noticeable can be provided by performing printing with a greater pass count than in the 6-color print mode.

The present invention has been described in detail with respect to preferred embodiments, and it will now be apparent from the foregoing to those skilled in the art that changes and modifications maybe made without departing from the invention in its broader aspect, and it is the intention, therefore, in the apparent claims to cover all such changes and modifications as fall within the true spirit of the invention.

This application claims priority from Japanese Patent Application No. 2004-024840 filed Jan. 30, 2004, which is hereby incorporated by reference herein.

What is claimed is:

1. An ink jet printing apparatus that forms an image on a print medium by performing a main scan motion and a sub-scan motion, with the main scan motion performed by making a print head carry out a plurality of scan motions in a predetermined direction on a print medium, the print head having an away of a plurality of nozzles for ejecting ink of a plurality of colors, each scan motion involving the ink being ejected from the plurality of nozzles onto the print medium, and the the sub-scan motion performed by moving the print medium and the print head relative to each other a predetermined amount in a direction different from a direction of the scan motion of the print head; the ink jet printing apparatus comprising:

print mode selection means for selecting one print mode among a plurality of print modes including a first print mode and a second print mode, the first print mode using a first number of colors of ink employed for printing and the second print mode using a second number of colors of ink smaller than the first number of colors of ink used in the first print mode; and control means for controlling the printing operation performed according to the mode selected by the mode selection means, wherein the control means controls so that an image is printed by making the print head carry out a plurality of main scan motions for a predetermined area on the print medium, the control means further controls so that the number of main scan motions performed for the predetermined area on the print medium in the second print mode is greater than the number of main scan motions in the first print mode, and the control means controls so that, in the first print mode and the second print mode, printing of an image on the predetermined area on the print medium is completed through a plurality of scan motions of the print head by repeating the printing operation achieved through the scan motion of the print head and a print medium feeding operation covering a width smaller than a print width printed through a single scan operation of the print head in a print medium feeding direction.

2. The ink jet printing apparatus as claimed in claim 1, wherein, in the first print mode, the image is printed using a plurality of chromatic colors of ink and an achromatic color of ink and, in the second print mode, the image is printed using a smaller number of chromatic colors of ink than in the first print mode and an achromatic color of ink.

3. The ink jet printing apparatus as claimed in claim 2, wherein the ink of the achromatic color is used more than ink of other colors in printing of the image in the second print mode.

4. The ink jet printing apparatus as claimed in claim 1, wherein the print head is an array of nozzle rows arranged according to the color of ink to be ejected in a direction of the main scan motion.

5. A printing system using an ink jet printing apparatus that forms an image on a print medium by performing a main scan motion and a sub-scan motion, with the main scan motion performed by making a print head carry out a plurality of scan motions in a predetermined direction on a print medium, the print head having an away of a plurality of nozzles for ejecting ink of a plurality of colors, each scan motion involving the ink being ejected from the plurality of nozzles onto the print medium, and the sub-scan motion performed by moving the print medium and the print head relative to each other a predetermined amount in a direction different from a direction of the scan motion of the print head; the printing system comprising:

a plurality of print modes, each using a different number of colors of ink for forming the image on the print medium;

print mode selection means for selecting a specific print mode to be used among the plurality of print modes;

print method determination means for determining a print method corresponding to the print mode selected by the print mode selection means; and control means for controlling so that printing of an image on a predetermined area on the print medium is completed through a plurality of main scan motions, wherein the print method determination means sets up a print method in a predetermined print mode using a smaller number of colors of ink for printing than in other print modes, so as to have a greater number of main scan motions for printing the image on the predetermined area as controlled by the control means than in the other print modes, and the control means controls so that, in the first print mode and the second print mode, printing of an image on the predetermined area on the print medium is completed through a plurality of scan motions of the print head by repeating the printing operation achieved through the scan motion of the print head and a print medium feeding operation covering a width smaller than a print width printed through a single scan operation of the print head in a print medium feeding direction.

6. An ink jet printing method with an ink jet printing apparatus that forms an image on a print medium by performing a main scan motion and a sub-scan motion, with the main scan motion performed by making a print head carry out a plurality of scan motions in a predetermined direction on a print medium, the print head having an array of a plurality of nozzles for ejecting ink of a plurality of colors, each scan motion involving the ink being ejected from the plurality of nozzles onto the print medium, and the sub-scan motion being performed by moving the print medium and the print head relative to each other a predetermined amount in a direction different from a direction of the scan motion of the print head; the ink jet printing method comprising:

a selection process for selecting a mode among a plurality of modes, each using a different number of colors of ink for printing the image; and a print process for printing the image on the print medium according to the mode selected in the selection process, wherein the print process performs printing by setting up a print method in a predetermined print mode using a smaller number of colors of ink for printing than in other print modes, so as to have a greater number of main scan motions for printing the image on the predetermined area as controlled by the control means than in the other print modes, and the control means controls so that, in the first print mode and the second print mode, printing of an image on the predetermined area on the print medium is completed through a plurality of scan motions of the print head by repeating the printing operation achieved through the scan motion of the print head and a print medium feeding operation covering a width smaller than a print width printed through a single scan operation of the print head in a print medium feeding direction.

* * * * *

UNITED STATES PATENT AND TRADEMARK OFFICE

CERTIFICATE OF CORRECTION

PATENT NO. : 7,287,830 B2
APPLICATION NO. : 11/041278
DATED : October 30, 2007
INVENTOR(S) : Ide et al.

It is certified that error appears in the above-identified patent and that said Letters Patent is hereby corrected as shown below:

COLUMN 1:
Line 29, “images” should read --images.--.
Line 65, “is” should be deleted.

COLUMN 2:
Line 24, “link” should read --ink--.
Line 33, “compared” should read --compared to--.

COLUMN 6:
Line 64, “nanogram” should read --nanograms--.

COLUMN 8:
Line 32, “LUT’s” should read --LUT--.

COLUMN 9:
Line 37, “method that” should read --method in which--.

COLUMN 10:
Line 40, “process” should read --processing--.
Line 43, “that” should read --when--.

COLUMN 12:
Line 59, “maybe” should read --may be--.

UNITED STATES PATENT AND TRADEMARK OFFICE

CERTIFICATE OF CORRECTION

PATENT NO. : 7,287,830 B2
APPLICATION NO. : 11/041278
DATED : October 30, 2007
INVENTOR(S) : Ide et al.

It is certified that error appears in the above-identified patent and that said Letters Patent is hereby corrected as shown below:

COLUMN 13:
Line 7, “away” should read --array--.
Line 10, “the” (second occurrence) should be deleted.
Line 60, “away” should read --array--.

Signed and Sealed this

Tenth Day of March, 2009

JOHN DOLL
*Acting Director of the United States Patent and Trademark Office*